US007915548B2

(12) United States Patent
Allaire et al.

(10) Patent No.: US 7,915,548 B2
(45) Date of Patent: Mar. 29, 2011

(54) COMBINED CIRCUIT BREAKER AND DISCONNECTOR FOR AN ALTERNATOR WITH ACTUATION BY AN ASSEMBLY OF A MAIN SHAFT AND SECONDARIES SHAFTS

(75) Inventors: Xavier Allaire, Chassieu (FR); Philippe Manin, Lyons (FR)

(73) Assignee: Areva T&D SA, Paris La Defense Cedex (FR)

( * ) Notice: Subject to any disclaimer, the term of this patent is extended or adjusted under 35 U.S.C. 154(b) by 303 days.

(21) Appl. No.: 12/212,472

(22) Filed: Sep. 17, 2008

(65) Prior Publication Data

US 2009/0071809 A1 Mar. 19, 2009

(30) Foreign Application Priority Data

Sep. 17, 2007 (FR) ..... 07 57629

(51) Int. Cl.
*H01H 3/00* (2006.01)

(52) U.S. Cl. ..... 200/17 R; 200/18

(58) Field of Classification Search ..... None
See application file for complete search history.

(56) References Cited

U.S. PATENT DOCUMENTS

| | | | | |
|---|---|---|---|---|
| 3,564,465 | A * | 2/1971 | Harvey | 335/73 |
| 3,727,019 | A * | 4/1973 | Harvey | 218/140 |
| 2008/0011591 | A1 | 1/2008 | Frigiere et al. | |

FOREIGN PATENT DOCUMENTS

| | | | |
|---|---|---|---|
| DE | 10016950 | A1 | 10/2001 |
| DE | 102005013231 | B3 | 9/2006 |
| FR | 2744284 | A1 | 8/1997 |
| FR | 2902923 | A1 | 1/2009 |

* cited by examiner

*Primary Examiner* — renee s luebke
*Assistant Examiner* — Lisa Klaus
(74) *Attorney, Agent, or Firm* — Nixon Peabody LLP

(57) ABSTRACT

An arrangement for synchronizing and the actuation of a set of three interrupters, tow of which are disconnectors and one is a switch, in a combined circuit breaker and disconnector for an alternator is described. This allows for fitting of an accessory shaft for actuation purposes, which is specifically dedicated to the actuation of one of the two disconnection interrupters and to set it in rotation only after a final angle of rotation of a main shaft, which is itself dedicated to the actuation of the other disconnecting interrupter and actuation of the switching interrupter.

10 Claims, 2 Drawing Sheets

COMBINED CIRCUIT BREAKER AND DISCONNECTOR FOR AN ALTERNATOR WITH ACTUATION BY AN ASSEMBLY OF A MAIN SHAFT AND SECONDARIES SHAFTS

CROSS REFERENCE TO RELATED APPLICATIONS OR PRIORITY CLAIM

This application claims priority to French Patent Application No. 07 57629, filed Sep. 17, 2007.

TECHNICAL FIELD AND PRIOR ART

This invention relates to a system for switching and disconnection in an alternator circuit breaker, and to its associated kinematic.

Numerous switching and disconnection systems for an alternator circuit breaker are already known.

One arrangement that can be mentioned is that in the document DE 100 16950.

Another one which may also be mentioned is the combined circuit breaker and disconnector for an alternator that is taught by patent application FR 06/52628, in which actuation of the two disconnecting interrupters and the switching interrupter is achieved using a cylindrical cam.

The known arrangements involve one of the following:

- a heavy moving weight and strong forces, which do not make it possible to guarantee reliable operation over a period of time;
- the insertion of an arc and/or a resistance in the switching circuit; and
- the use of a spring in the actuating mechanism to open the second disconnector.

The object of the invention is accordingly to propose an arrangement that aims to mitigate all or some of the disadvantages discussed above.

DISCLOSURE OF THE INVENTION

To this end, a combined circuit breaker and disconnector for an alternator is provided that comprises the following:

- a first interrupter, being a disconnecting interrupter, that comprises a first pair of contacts movable in straight line motion relative to each other;
- a second interrupter, being a switching interrupter, that comprises a second pair of contacts movable in straight line motion relative to each other, the second interrupter being connected electrically in parallel with the first interrupter;
- a third interrupter, being a disconnecting interrupter and comprising a third pair of contacts that are movable in straight line motion relative to each other, the third interrupter being connected electrically in series with the second interrupter and in parallel with the first interrupter;
- actuator means for actuating a moving contact of each interrupter; and
- synchronizer means serving, during a given opening operation of the circuit breaker, to cause the contacts of the first interrupter to separate before the contacts of the second interrupter are separated from each other, the contacts of this second pair being separated before the third contacts are fully separated from each other;
- the synchronizer means and the actuator means of the three interrupters, being themselves coupled and actuated by a single control means; and

- the first and third pairs of contacts being movable along a common axis (XX').

According to the invention;

- the actuator means for the first disconnecting interrupter include at least one main shaft that is adapted to be set in rotation by the said single control means, and a main lever that is fixed to the main shaft and that has one end connected to one of the moving contacts;
- the actuator means for the third interrupter comprise at least one accessory shaft parallel to the main shaft, and an accessory lever that is fixed to the accessory shaft, with one end of the accessory lever being coupled to one of the moving contacts by means of a multiplier device; and
- the synchronizer means between the first and third interrupters are so arranged that, during a given opening operation of the circuit breaker, the accessory shaft is set in rotation over only a final angle of rotation of the main shaft, whereby to separate the third pair of contacts entirely from each other.

The term "accessory" is to be understood herein, and within the scope of the invention, to mean a secondary shaft, that is to say a shaft that is not directly coupled to the single control means.

With the arrangement of the invention, the main actuator is operated over the whole stroke of the main shaft, and an accessory shaft is actuated only on the end of the opening movement. The accessory shaft can be operated by means of a cam, or by a chain, or by any other means. Since the angular stroke of this shaft is small, the lever drives a pantograph or other mechanism so as to multiply the stroke in the secondary disconnector, while at the same time keeping overall size small (having regard to the available space).

The main shaft also drives a cam in order to operate the vacuum chamber, the opening of which causes the arc to be interrupted. This chamber is open at the beginning of the opening operation so as to avoid useless stressing of the insulators when the apparatus is closed (which would run the risk of creeping the insulators). It is therefore closed before opening the main contacts, so as to allow the current to pass. Subsequently it is opened, and then closed again at the end of the stroke, so as to put the zone that lies between the vacuum vessel and the secondary disconnector at line potential (this zone may be put at line potential by means of another apparatus). This system using cam control enables strokes to be controlled that are very different (from 10 millimeters (mm) to 200 mm, and more if necessary).

Preferably, the accessory lever is coupled directly to the multiplier device through a single connecting rod.

In one preferred version of the invention, the multiplier device comprises a pantograph.

In another preferred version, the synchronizer means between the first and third switching interrupters comprise, firstly, a cam fixed to the main shaft, and secondly, a coupling lever that is fixed to the accessory shaft and that carries a pin that is in engagement against the cam, the profile of the cam being such that the pin is displaced only over the final angle of rotation of the main shaft.

Preferably, the cam is formed with a guide groove in which the pin slides, the guide groove having two curved portions of different curvatures.

In one advantageous embodiment:

- the actuator means for the second switching interrupter comprise at least one further accessory shaft parallel to the main shaft, and a farther accessory lever that is fixed to the other accessory shaft, and one end of which is coupled directly to one of its moving contacts; and the synchronizer means between the first and second interrupters are arranged in such a way that, during a given opening movement of the circuit breaker, the said further accessory shaft is successively set in rotation or stopped over the complete angle of rotation of the main shaft, whereby successively to close the pair of contacts of the third interrupter that is initially open, to open it, to hold it open, and then to close it again.

In one preferred version, the synchronizer means between the first and second interrupters comprises, firstly, a further cam coupled to the main shaft, and secondly, a further coupling lever that is fixed to the said further accessory shaft and that carries a further pin that is in engagement against the cam.

In this particular preferred version, the said further cam may be formed with a guide groove in which the said further pin slides, the guide groove having four curved portions of different curvatures.

Again in the same version, the said further cam is coupled to the main shaft through a single connecting rod.

Moreover, the second pair of contacts may be in straight line motion on the same axis as that of the first and third pairs, and the circuit breaker may include a double lever, having one arm that constitutes the said further accessory lever, with its other arm being the said further coupling lever.

DETAILED DESCRIPTION OF PARTICULAR EMBODIMENTS

Figure 1:
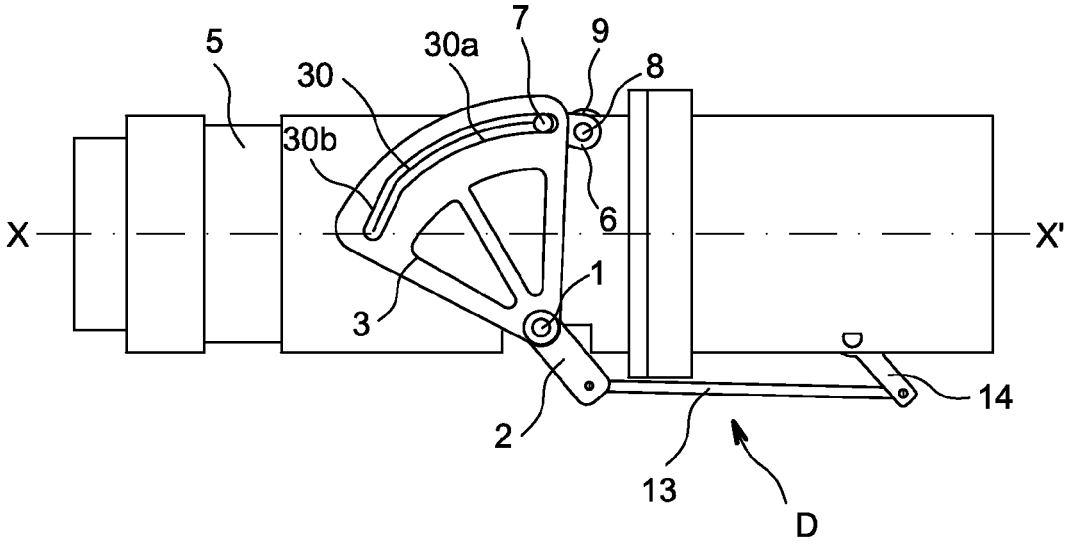
FIG. 1 is a top plan view of one embodiment of a combined circuit breaker and disconnector for an alternator in accordance with the invention.
Figure 2:
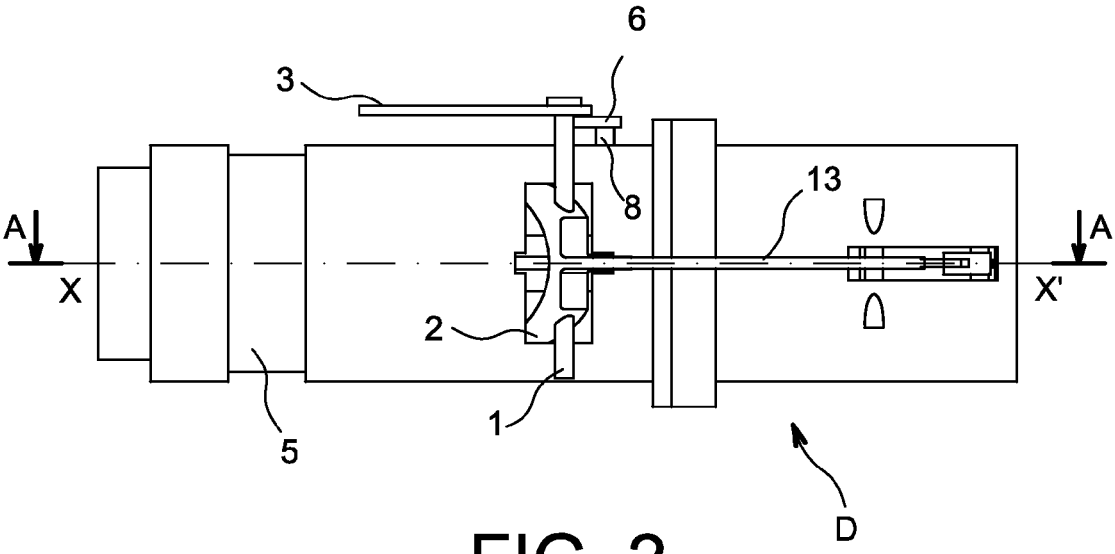
FIG. 2 is a side view of the circuit breaker shown in FIG. 1.

As shown, the combined circuit breaker and disconnector (D) for an alternator comprises, respectively, two disconnecting interrupters 5, 5*a* and 12, 12*a*, and a switching interrupter 16, 17, all of which are arranged on the same axis XX'.

One of the disconnecting interrupters shown comprises a pair of contacts 12 and 12*a* that are movable relative to each other in straight line motion.

The switching interrupter includes a pair of contacts 16 and 17 that are also movable relative to each other in straight line motion. This switching interrupter is electrically connected in parallel with the disconnecting interrupter 5, 5*a*. The switching interrupter constituted by a vacuum chamber in the embodiment shown.

The other disconnecting interrupter has a pair of contacts 5, 5*a* that are movable relative to each other in straight line motion.

In the alternator circuit breaker D shown, there are provided means (denoted, respectively, 2; 13, 14, 15; and 3, 6, 7, 8, 9, 11) for actuating a moving contact 5, 12 of each disconnecting interrupter and the moving contact 16 of the switching interrupter.

It is also provided with synchronizer means 3, 30 and 14, 140 that act, during a given opening operation of the circuit breaker, to cause the contacts 5 and 5*a* of the first disconnecting interrupter to separate before the contacts 16 and 17 of the switching interrupter are separated from each other, the contacts 16 and 17 being themselves arranged to separate before the contacts 12 and 12*a* of the other disconnecting interrupter separate completely.

Finally in the alternator circuit breaker D of the invention, coupling and actuation of the synchronizer and actuator means for all three interrupters is obtained by means of a single control means, not shown.

In the apparatus of the invention, the actuator means for the disconnecting interrupter 5, 5*a* comprise at least one main shaft 1 that is actuated in rotation by the mechanical control means. A main lever 2 is rigidly mounted on this shaft 1. The lever 2 is connected to the tube of the main disconnector 5 by means of a single intermediate connecting rod (not shown).

Figure 3:
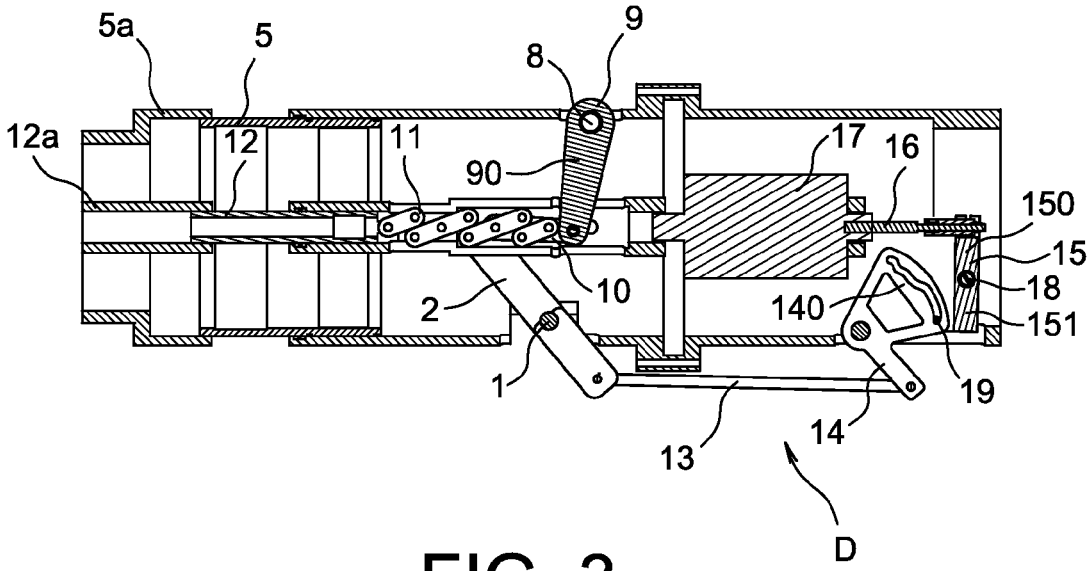
FIG. 3 is a view in longitudinal section taken on the line A-A, showing the circuit breaker of FIG. 2.

The actuator means for the other disconnecting interrupter 12, 12*a* comprise at least one accessory shaft 8 that is parallel to the main shaft 1, together with an accessory lever 9 that is fixed to the accessory shaft 8, and that has an end 90 coupled to the moving contact 12 by means of a multiplier device 10, 11, which is in the form of a pantograph in the embodiment shown (see FIG. 3).

The synchronizer means between the two disconnecting interrupters 5, 5*a* and 12, 12*a* are arranged in such a way that, during a given opening operation of the circuit breaker, the accessory shaft 8 is put into rotation, in order to separate the pair of contacts 12 and 12*a* of the disconnector fully from each other, only over a final angle of rotation of the main shaft 1.

More precisely, the cam 3 guides a follower pin 7 that is mounted on a coupling lever 6, the profile of the cam 3 being such that the follower pin is displaced only over the final angle of rotation of the main shaft 1. More precisely still, the cam 3 is formed with a guide groove 30 in which the follower pin 7 slides, the guide groove having two curved portions 30*a* and 30*b* of different curvatures.

The coupling lever 6, and the accessory lever 9, are mounted on the accessory shaft 8. The shape of the groove 30 in the cam 3 enables the accessory shaft 8 to be driven in rotation during only part of the stroke of the main shaft 3. The accessory lever 9 is connected to a single connecting rod 10 that directly actuates a pantograph 11, which itself controls the movement of the tube of the disconnector 12.

The actuator means for the switching interrupter or vacuum chamber 16, 17 comprise at least one further accessory shaft 18 parallel to the main shaft 1, together with a further accessory lever 150 that is fixed to the other accessory shaft 18, and that has one end coupled directly to the moving contact 16.

As shown, the synchronizer means between the disconnecting interrupter 12, 12*a* and the switching interrupter 16, 17 are arranged in such a way that, during a given opening operation of the circuit breaker, the other accessory shaft 18 is, successively, set in rotation or stopped over the full angle of rotation of the main shaft 1, so as successively to close the pair of contacts 16 and 17 of the switching interrupter which were initially open, to open it, and then to hold it open, and finally to close it again.

In the embodiment shown in FIG. 3, this result is achieved by providing a further cam 14 that is coupled to the main shaft 1 through the outer end of the main lever 2, which is itself connected to a single connecting rod 13 that actuates the said further cam 14. The groove 140 of this further cam 14 permits pivoting movement of the double lever 15 that actuates the vacuum chamber 17 via a pull rod 16.

More precisely, a further coupling lever 151 is provided by way of a synchronizer means, being fixed to the other accessory shaft 150 and carrying a further follower pin 19, which slides in the guide groove 140 of the further cam 14.

Figure 3A:
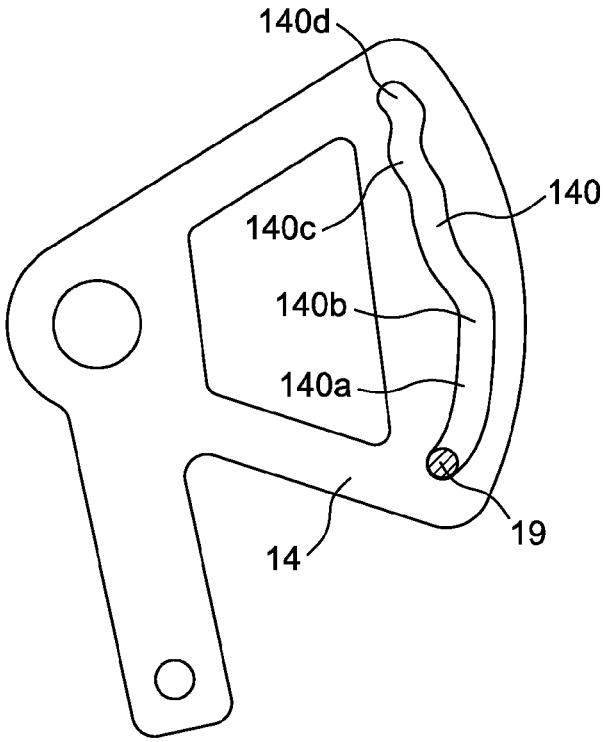
FIG. 3A is an enlarged view of a part of the circuit breaker shown in FIG. 3.

The guide groove 140 of the same further cam 14 has four curved portions 140*a*, 140*b*, 140*c*, and 140*d*, which all have different curvatures (see FIG. 3A).

The further cam 14 is also coupled directly to the main shaft 1 through a single connecting rod 13.

In the embodiment shown, the other coupling lever 150 and the other accessory lever 151 are made in one piece, which is a double lever 15.

The invention claimed is:

1. A combined circuit breaker and disconnector for an alternator, comprising:

a first interrupter, being a disconnecting interrupter, that comprises a first pair of contacts (movable in straight line motion relative to each other;

a second interrupter, being a switching interrupter, that comprises a second pair of contacts movable in straight line motion relative to each other, the second interrupter being connected electrically in parallel with the first interrupter;

a third interrupter, being a disconnecting interrupter and comprising a third pair of contacts that are movable in straight line motion relative to each other, the third interrupter being connected electrically in series with the second interrupter and in parallel with the first interrupter;

actuator means for actuating a moving contact of each interrupter; and synchronizer means serving, during a given opening operation of the circuit breaker, to cause the contacts of the first interrupter to separate before the contacts of the second interrupter are separated from each other, the contacts of this second pair being separated before the third contacts are fully separated from each other;

the synchronizer means and the actuator means of the three interrupters being themselves coupled and actuated by a single control means; and the first and third pairs of contacts being movable along a common axis, the circuit breaker and disconnector being characterized in that:

the actuator means for the first disconnecting interrupter include at least one main shaft that is adapted to be set in rotation by said single control means, and a main lever that is fixed to the main shaft and that has one end connected to one of the moving contacts;

the actuator means for the third interrupter comprise at least one accessory shaft parallel to the main shaft, and an accessory lever that is fixed to the accessory shaft, and one end of the accessory lever being coupled to one of the moving contacts by means of a multiplier device; and the synchronizer means between the first and third interrupters are so arranged that, during a given opening operation of the circuit breaker, the accessory shaft is set in rotation over only a final angle of rotation of the main shaft, whereby to separate the third pair of contacts entirely from each other.

2. A circuit breaker according to claim 1, wherein the accessory lever is coupled directly to the multiplier device through a single connecting rod.

3. A circuit breaker according to claim 1, wherein the multiplier device comprises a pantograph.

4. A circuit breaker according to claim 1, wherein the synchronizer means between the first and third switching interrupters comprises, firstly, a cam fixed to the main shaft, and secondly, a coupling lever that is fixed to the accessory shaft and that carries a pin that is in engagement against the cam, the cam having a profile, the profile of the cam being such that the pin is displaced only over the final angle of rotation of the main shaft.

5. A circuit breaker according to claim 1, wherein the cam is formed with a guide groove in which a pin slides, the guide groove having two curved portions of different curvatures.

6. A circuit breaker according to claim 1, wherein:

the actuator means for the second switching interrupter comprise at least one further accessory shaft parallel to the main shaft, and a further accessory lever that is fixed to an other accessory shaft, and one end of which is coupled directly to one of its moving contacts; and the synchronizer means between the first and second interrupters are arranged in such a way that, during a given opening movement of the circuit breaker, said further accessory shaft is successively set in rotation or stopped over the complete angle of rotation of the main shaft, whereby successively to close the pair of contacts of the third interrupter that is initially open, to open it, to hold it open, and then to close it again.

7. A circuit breaker according to claim 6, wherein the synchronizer means between the first and second interrupters comprises, firstly, a further cam coupled to the main shaft, and secondly, a further coupling lever that is fixed to said further accessory shaft and that carries a further pin that is in engagement against the cam.

8. A circuit breaker according to claim 7, wherein said further cam is formed with a guide groove in which said further pin slides, the guide groove having four curved portions of different curvatures.

9. A circuit breaker according to claim 7, wherein said farther cam is coupled to the main shaft through a single connecting rod.

10. A circuit breaker according to claim 7, including a double lever, having one arm that constitutes said further accessory lever, with its other arm being said further coupling lever, and in which the second pair of contacts is movable in relative straight line motion along the same axis as that of the first and third pairs of contacts.

* * * * *